US006863575B2

(12) United States Patent
Hyland

(10) Patent No.: US 6,863,575 B2
(45) Date of Patent: Mar. 8, 2005

(54) RJ MODULAR CONNECTOR HAVING PRINTED CIRCUIT BOARD HAVING CONDUCTIVE TRADE TO BALANCE ELECTRICAL COUPLINGS BETWEEN TERMINALS

(75) Inventor: James Hyland, Harrisburg, PA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 236 days.

(21) Appl. No.: 10/190,395

(22) Filed: Jul. 2, 2002

(65) Prior Publication Data

US 2002/0177369 A1 Nov. 28, 2002

Related U.S. Application Data

(63) Continuation of application No. 09/863,942, filed on May 22, 2001, now Pat. No. 6,413,121.

(51) Int. Cl.[7] ..... H01R 24/00

(52) U.S. Cl. ..... 439/676; 439/608; 439/620; 439/76.1; 439/941

(58) Field of Search ..... 439/676, 76.1, 439/620, 941, 608, 607, 609, 610, 108, 101

(56) References Cited

U.S. PATENT DOCUMENTS 5,069,641 A 12/1991 Sakamoto et al.
5,947,772 A 9/1999 Arnett et al.
6,102,741 A 8/2000 Boutros et al.
6,120,329 A 9/2000 Steinman
6,276,943 B1 8/2001 Boutros et al.
6,283,795 B1 9/2001 Chen
6,290,546 B1 9/2001 Pharney
6,305,987 B1 10/2001 Crane, Jr. et al.
6,413,121 B1 * 7/2002 Hyland ..... 439/676

OTHER PUBLICATIONS

The Siemon Company, "Through–Hole and Multi–Planar® Technology", at http://www.siemon.com/white_papers/99–08–30–through–hole.asp.

* cited by examiner

*Primary Examiner*—Truc Nguyen
(74) *Attorney, Agent, or Firm*—Wei Te Chung

(57) ABSTRACT

A RJ modular connector comprises a housing defining a plug receiving section, and a terminal core receiving section. A terminal core is received in the terminal core receiving section and includes a plurality of terminals. A substrate is provided having a conductive traces thereon. The terminals are securely mounted onto the substrate. An electrical connection is established between a first terminal and the conductive trace, and portion of the conductive trace is arranged to create a first electrical coupling between the first and third terminals thereby balancing a second electrical coupling between the first terminal and a second terminal arranged between the first and third terminals.

18 Claims, 11 Drawing Sheets

RJ MODULAR CONNECTOR HAVING PRINTED CIRCUIT BOARD HAVING CONDUCTIVE TRADE TO BALANCE ELECTRICAL COUPLINGS BETWEEN TERMINALS

CROSS-REFERENCE TO THE RELATED APPLICATION

This patent application is a continuation application (CA) of U.S. Pat. Ser. No. 09/863.942, filed May 22, 2001, now U.S. Pat. No. 6,413,121.

FIELD OF THE INVENTION

The present invention relates to a RJ modular connector, and more particularly to a RJ modular connector having a substrate provided therein to balance electrical couplings between terminals.

DESCRIPTION OF THE PRIOR ART

RJ modular connector has been widely used in telecommunication system since it was firstly created. A so-called RJ45 modular connector has been widely used in the network system.

The RJ45 modular connector includes totally eight terminals. Resulting from miniaturization of the computer, all corresponding components, including connectors, have to be reduced for their dimension and size. One of the negative consequences or problem created from miniaturization is electrical coupling between terminals. When the RJ connector is used in low speed signal transmission, the couplings between adjacent terminals can be ignored in light of its effect. However, when the RJ connector is used for high speed signal transmission, the couplings between adjacent terminals create a great problem. Unless the electrical coupling can be effectively controlled within an accepted level, it is unlikely that the RJ 45 modular connector can be used in the high-speed signal transmission.

One of the approaches is to select a pair of terminals as a differential pair. In the differential pair, two terminals transmit the same signal but with inverted phase. By this arrangement, the couplings coupled thereto can be finally subtracted in a data processing unit.

As shown in the catalog from The Siemon Company which will be submitted later with IDS, there are at least eight different patterns in selecting terminals as differential pair, i.e. T568A, T568B, USOC 4-pair, USOC 1-, 2-or 3-pair, 10BASE-T (802.3), Token Ring (802.5), 3-pair (MMJ), and TP-PMD (X3T9.5) and ATM. In each implementation, two terminals are selected as a pair in which some are close to each other, while some are apart from each other. Each pattern has its own uniqueness, while each also carries a coupling issue need to be solved.

Among those patterns, T568A and T568B are widely used and in T568A, terminals 1, 2 configure $3^{rd}$ pair, terminals 3, 6 configure $2^{nd}$ pair, terminals 4, 5 configure $1^{st}$ pair, while terminals 7, 8 configure $4^{th}$ pair. In T568B, terminals 1, 2 configure $2^{nd}$ pair, terminals 3, 6 configure $3^{rd}$ pair, terminals 4, 5 configure $1^{st}$ pair, while terminals 7, 8 configure $4^{th}$ pair.

Since those eight terminals are equally spaced, electrical couplings between terminals will surely create some problems, i.e. coupling or cross-talk. For example, if we take terminal 3 into consideration, terminal 3 will naturally pick up energy coupled from terminals 2, and 4 which are close to terminal 3. On the other hand, terminal 6, which carries signal having inverted phase of the signal carried by terminal 3, will also pick up energy coupled from terminals 5 and 7. However, energy coupled into terminals 3, 6 from terminals 2 and 7 can not be suitably eliminated because terminals 3, 6 is unlikely to establish couplings between terminals 1 and terminals 8 to balance the couplings between terminals 2, 3 and 6, 7. Accordingly, signals transmitted by terminals 3, 6 carry noises generated by their adjacent terminals 2, 7. In addition, terminals 3 and 6 will also carry noises coupled thereto from terminals 4, 5 and which couplings should be also carefully taken to avoid certain noises.

In order to decrease the effects of electrical coupling between the ($3^{rd}$, $4^{th}$) and ($3^{rd}$, $2^{nd}$) terminals, and ($6^{th}$, $5^{th}$) and ($6^{th}$, $7^{th}$) terminals, many approaches have been provided, such as creating electrical couplings between $3^{rd}$ and $1^{st}$ terminals and $3^{rd}$ and $5^{th}$ terminals, to balance the electrical coupling between the $3^{rd}$ and $2^{nd}$ terminals and $3^{rd}$ and $4^{th}$ terminals, and creating electrical coupling between $6^{th}$ and $8^{th}$ terminals and $6^{th}$ and $5^{th}$ terminals to balance the electrical couplings between the $6^{th}$ and $7^{th}$ terminals and $6^{th}$ and $4^{th}$ terminals.

However, as mentioned above, those eight terminals are arranged in a common plane, it is impossible to create those balancing electrical couplings, i.e. ($1^{st}$, $3^{rd}$), ($3^{rd}$, $5^{th}$), and ($4^{th}$, $6^{th}$), ($6^{th}$, $8^{th}$) terminals when all terminals are located in the same level, it is unlikely to create any electrical channels therebetween to create those electrical couplings accordingly.

The Siemon Company, a US company, discloses a solution posted on the Internet, http://www.siemon.com/white papers/99-08-30-through-hole.asp. A hard copy thereof will be submitted with IDS for reference.

As clearly shown in FIG. 4 of that reference, $6^{th}$ and $2^{nd}$ terminals are arranged in the first layer, while $8^{th}$, $5^{th}$, $4^{th}$, and $1^{st}$ terminals are arranged in the second layer, and $7^{th}$ and $3^{rd}$ terminals are arranged in the third layer.

The $6^{th}$ terminal in the first layer has a rectangular loop having its longitudinal sides aligned with terminals $\mathbf{4}^{th}$ and $\mathbf{8}^{th}$ located in the second layer, while terminal 3 in the third layer also has a rectangular loop having its longitudinal sides aligned with terminals $\mathbf{5}^{th}$ and $\mathbf{1}^{st}$ located in the second layer.

In addition, the right longitudinal loop side of the terminal $\mathbf{6}^{th}$ further includes a square corresponding to a square formed in terminal $\mathbf{4}^{th}$. The left longitudinal loop side of the terminal 3 includes also a square with respect to the square formed on terminal $\mathbf{8}^{th}$.

Arrangements suggested by Siemon are to increase the couplings between ($1^{st}$, $3^{rd}$), ($3^{rd}$, $5^{th}$), and ($4^{th}$, $6^{th}$), ($6^{th}$, $8^{th}$) terminals thereby helping to balance electrical couplings of the terminals.

However, those eight or four set sets of terminals are arranged in three different layers, and each set of terminals are separately divided by an insulative sheet material. This will no doubt increase the complexity of the connector.

In addition, there are five different shapes and configurations among those eight terminals. Each terminal has its own shape which is different from each other, especially the $3^{rd}$ and $6^{th}$ terminals, each including the rectangular loop portion which overlap to corresponding terminals to create wanted electrical couplings. Each loop further forms the square to increase the electrical couplings with corresponding terminals having the square. The electrical couplings created can help to meet higher system requirement. The eight different configuration of the terminals will surely increase the difficulty and complexity in production.

There are some other approaches that including routing terminal tails of those $3^{rd}$, $6^{th}$ and $4^{th}$, $5^{th}$ terminals to alter their position and affect couplings between $3^{rd}$, $2^{nd}$ and $3^{rd}$, $4^{th}$; and $6^{th}$, $5^{th}$, and $6^{th}$, $7^{th}$ terminals. However routing terminal tails will inevitably increase the manufacturing cost.

U.S. Pat. No. 6,120,329 issued to Steinman on Sep. 19, 2000, discloses another approach to solve the above-addressed problem. Again, terminals are configured with different shapes and dimensions making the production complex.

U.S. Pat. No. 5,069,641 issued to Sakamoto et al. discloses a suggestion of using printed circuit board in the RJ modular housing, however, it addresses to different issues.

SUMMARY OF THE INVENTION

It is an object of this invention to provide an RJ modular connector, and more particularly to a RJ modular connector having a substrate with conductive traces provided therein to balance electrical couplings between terminals.

It is still an object of this invention to provide a RJ modular connector which can be easily manufactured.

In order to achieve the objective set forth, an RJ modular connector in accordance with the present invention comprises a housing defining a plug receiving section, and a terminal core receiving section. A terminal core is received in the terminal core receiving section and includes a plurality of terminals. A substrate is provided having conductive trace thereon. The terminals are securely mounted onto the substrate. An electrical connection is established between a first terminal and the conductive trace, and a portion of the conductive trace is arranged to create a first electrical coupling between the first terminal and a third terminal thereby balancing a second electrical coupling between the first terminal and a second terminal arranged between the first and third terminals.

BRIEF DESCRIPTION OF THE DRAWINGS

Other objects and further features of the present invention will be apparent from the following detailed description when read in conjunction with the accompanying drawings, in which.

DETAILED DESCRIPTION OF PREFERRED EMBODIMENTS

Figure 1A:
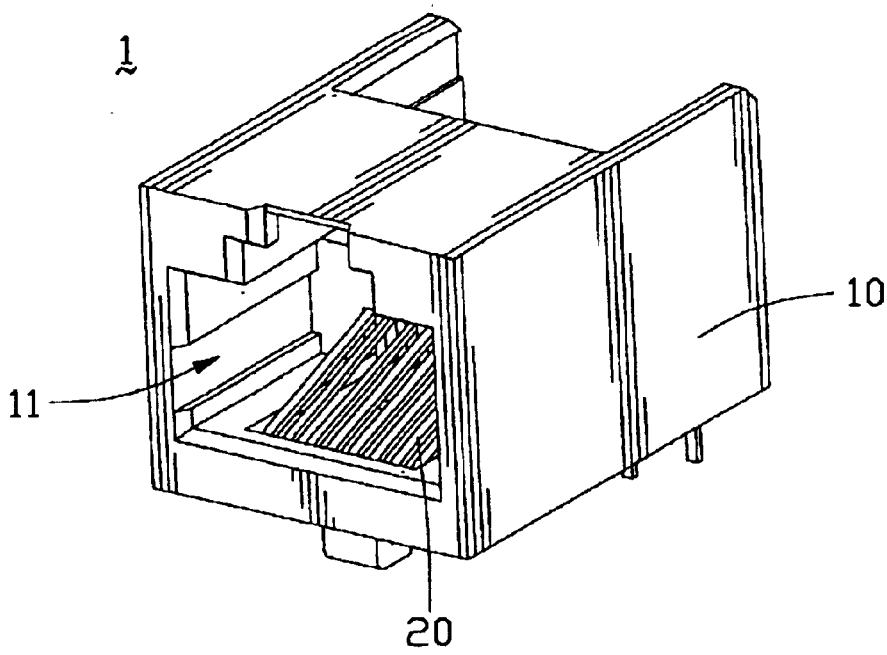
FIG. 1A is a perspective view of a RJ modular connector in accordance with the present invention.
Figure 1B:
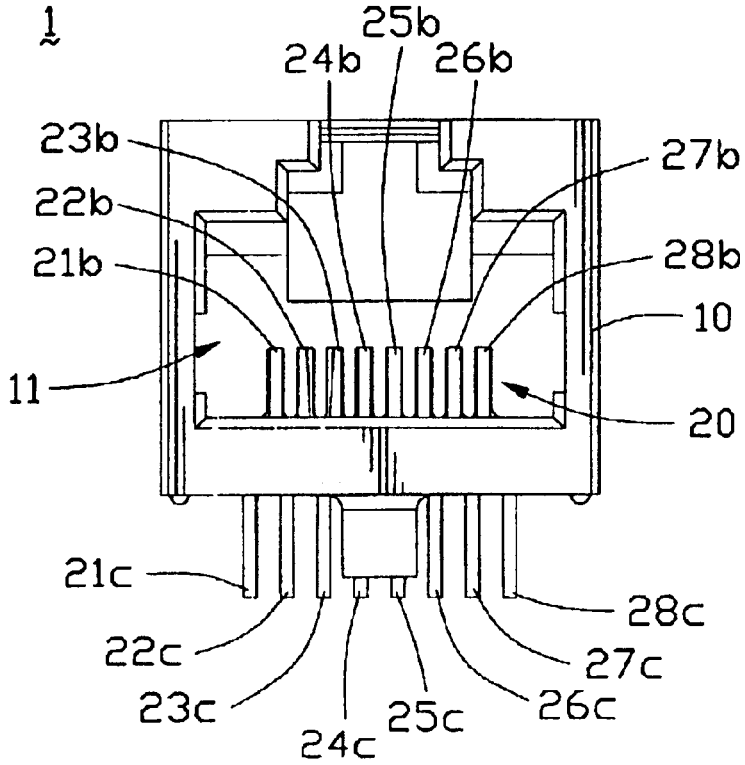
FIG. 1B is a front view of FIG. 1A.
Figure 1C:
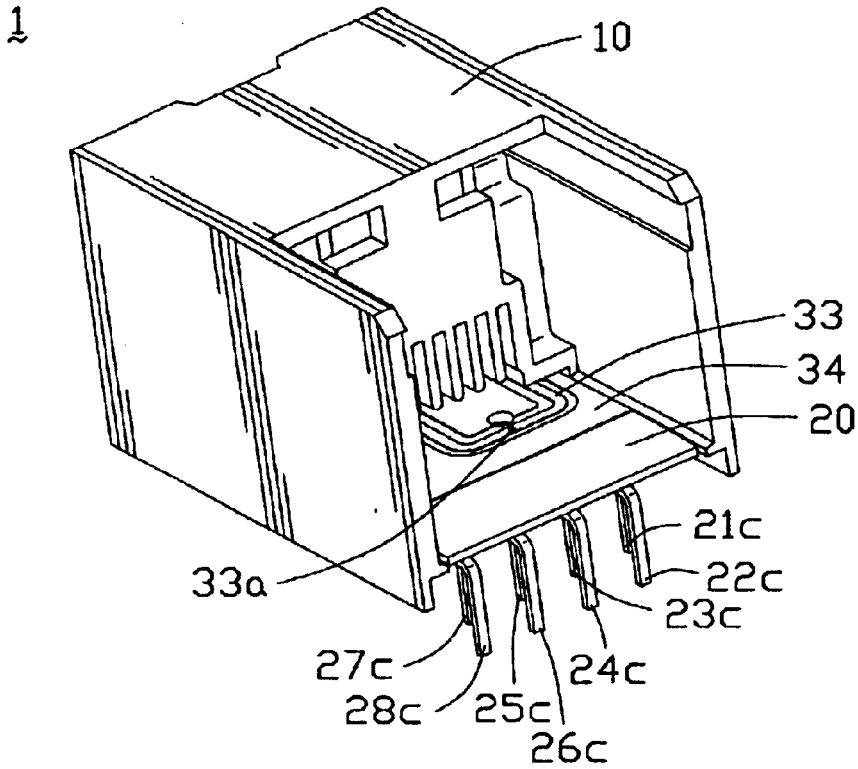
FIG. 1C is similar to FIG. 1A except viewed from a reverse direction.
Figure 1D:
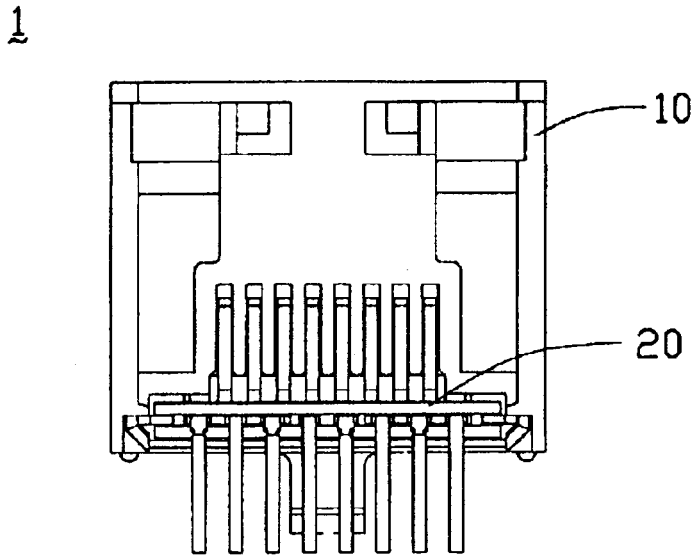
FIG. 1D is a front view of FIG. 1C.
Figure 1E:
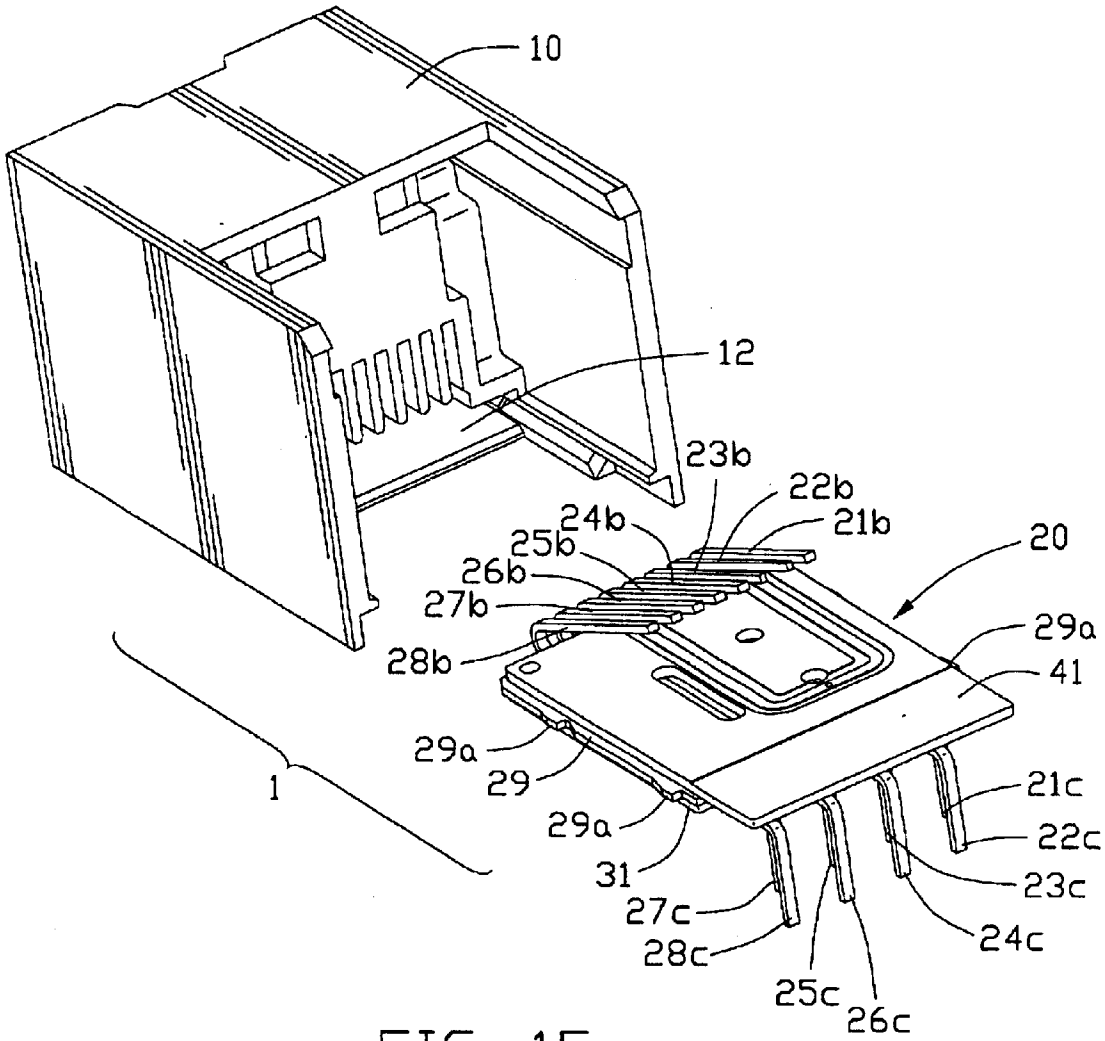
FIG. 1E is an exploded view of FIG. 1C.

Referring FIGS. 1A to 1E, a RJ modular connector 1 in accordance with the present invention includes a housing 10 defining a plug receiving space 11, and a terminal insert receiving space 12 in which a modular terminal insert 20 securely attached therein and with contacting portions 21*b*, 22*b*, 23*b*, 24*b*, 25*b*, 26*b*, 27*b*, and 28*b* extending into the plug receiving space 11, while leg portions 21*c*, 22*c*, 23*c*, 24*c*, 25*c*, 26*c*, 27*c* and 28*c* extending away from the housing 10. The RJ modular connector 1 has a general dimension and shape corresponding to existing industry specifications. Accordingly, no details are given thereto. The unique feature of the present invention resides on providing the modular terminal insert 20 which can be simply made in a cost-effective manner. In addition, the modular terminal insert 20 is arranged such that electrical couplings can be created between selected terminals to balance electrical couplings between selected terminals. By this arrangement, cross-talk between certain terminals can be effectively eliminated or reduced.

Referring to FIGS. 2A to 2D in conjunction with FIGS. 3A to 3F, the terminal insert 20 in accordance with the present invention includes a plurality of terminals 21, 22, 23, 24, 25, 26, 27, and 28 sandwiched between lower and upper or first and second printed circuit boards 31 and 41. Among the terminals, terminals 21, 22 configures a first pair, terminals 23, 26 configures a second pair, terminals 24, 25 configures a third pair, while terminals 27, 28 configures a fourth pair.

The lower printed circuit board 31 defines first (top) and second (bottom) surfaces 31*a*, 31*b* and with conductive footprints or conductive pads 321, 322, 323, 324, 325, 326, 327 and 328 formed on the first face 31*a*. A conductive loop 33 is formed on the second face 31*b* and surrounded by a grounding plane 34. The conductive loop 33 is electrically connected to the conductive footprints 323 by means of tunnels 33*a*. Since the tunnel 33*a* is a configured by a through-hole coated with conductive material, such as solder, and is known to the skill in the art, no details are given herebelow.

The upper printed circuit board 41 defines first (top) and second (bottom) surfaces 41*a*, 41*b* and with conductive footprints or conductive pads 421, 422, 423, 424, 425, 426, 427 and 428 formed on the second face 41*b*. A conductive loop 43 is formed on the first face 41*a* and surrounded by a grounding plane 44. The conductive loop 43 is electrically connected to the conductive footprints 426 by means of tunnels 43*a* which is identical to the tunnels 33*a*.

Among the footprints 321, 322, 323, 324, 325, 326, 327 and 328, the footprint 323 corresponding to terminal 23 includes first and second portions 323*a*, 323*b*; while footprint 326 with respect to terminal 26 includes also first and second portions 326*a*, 326*b*. Among the footprints 421, 422, 423, 424, 425, 426, 427 and 428, the footprint 426 with respect to the terminal 26 includes first and second portions 426*a*, 426*b*; while footprint 423 with respect to the terminal 23 includes also first and second portions 423*a*, 423*b*.

The terminals 21, 22, 23, 24, 25, 26, 27, and 28 can be securely sandwiched between the printed circuit boards 31, 41 by applying solder pastes on the footprints 321, 322, 323, 324, 325, 326, 327 and 328; and footprints 421, 422, 423, 424, 425, 426, 427 and 428, and then reflowing the solder pastes such that the terminals 21, 22, 23, 24, 25, 26, 27, and 28 are completely and securely attached to the footprints 321, 322, 323, 324, 325, 326, 327 and 328 of the lower printed circuit board 31; and footprints 421, 422, 423, 424, 425, 426, 427 and 428 of the upper printed circuit board 41.

Figure 2A:
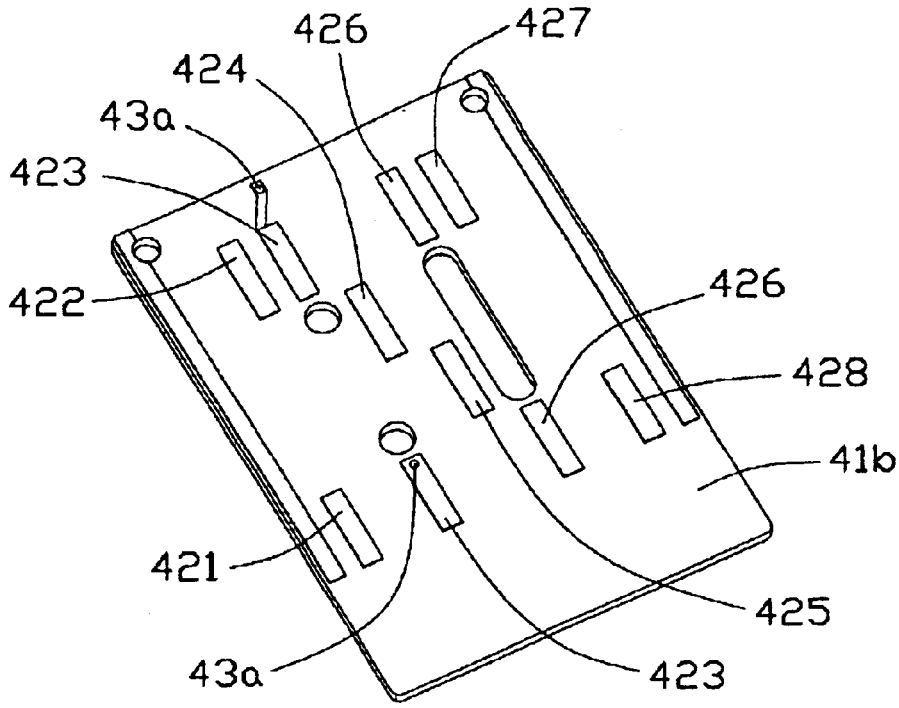
FIG. 2A is a bottom view of a top substrate.
Figure 2B:
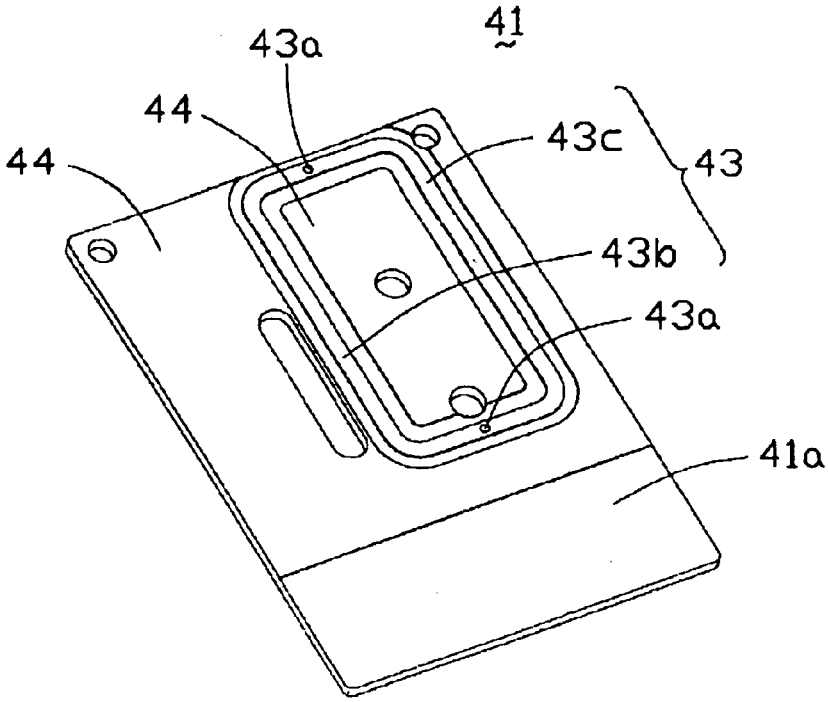
FIG. 2B is a top view of FIG. 2A.
Figure 2C:
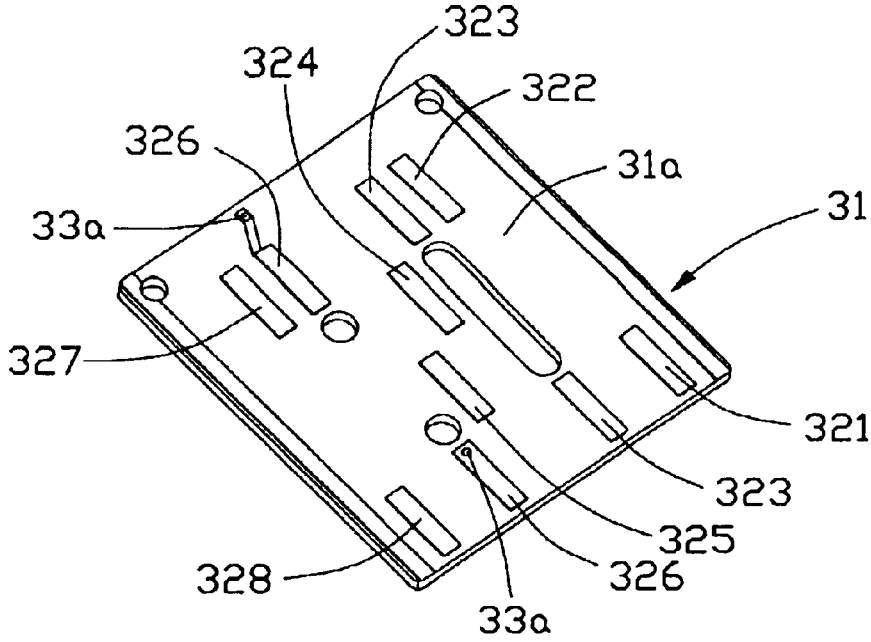
FIG. 2C is a top view of a bottom substrate.
Figure 2D:
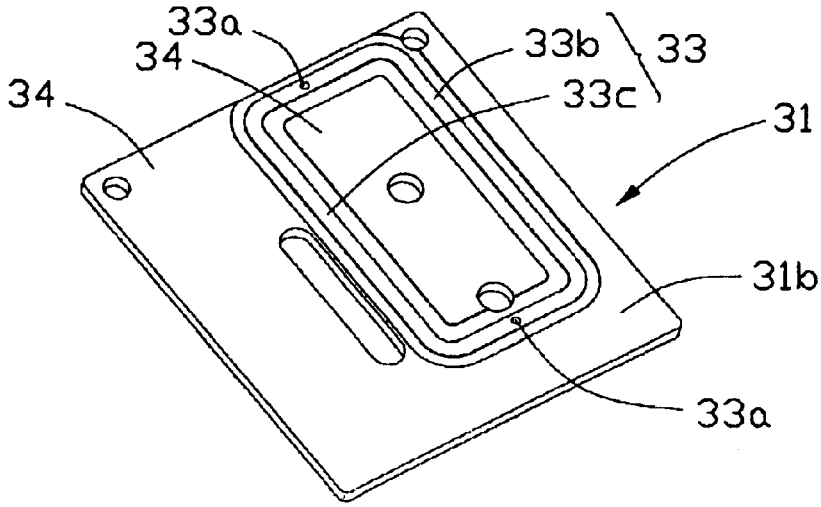
FIG. 2D is a bottom view of FIG. 2C.
Figure 3A:
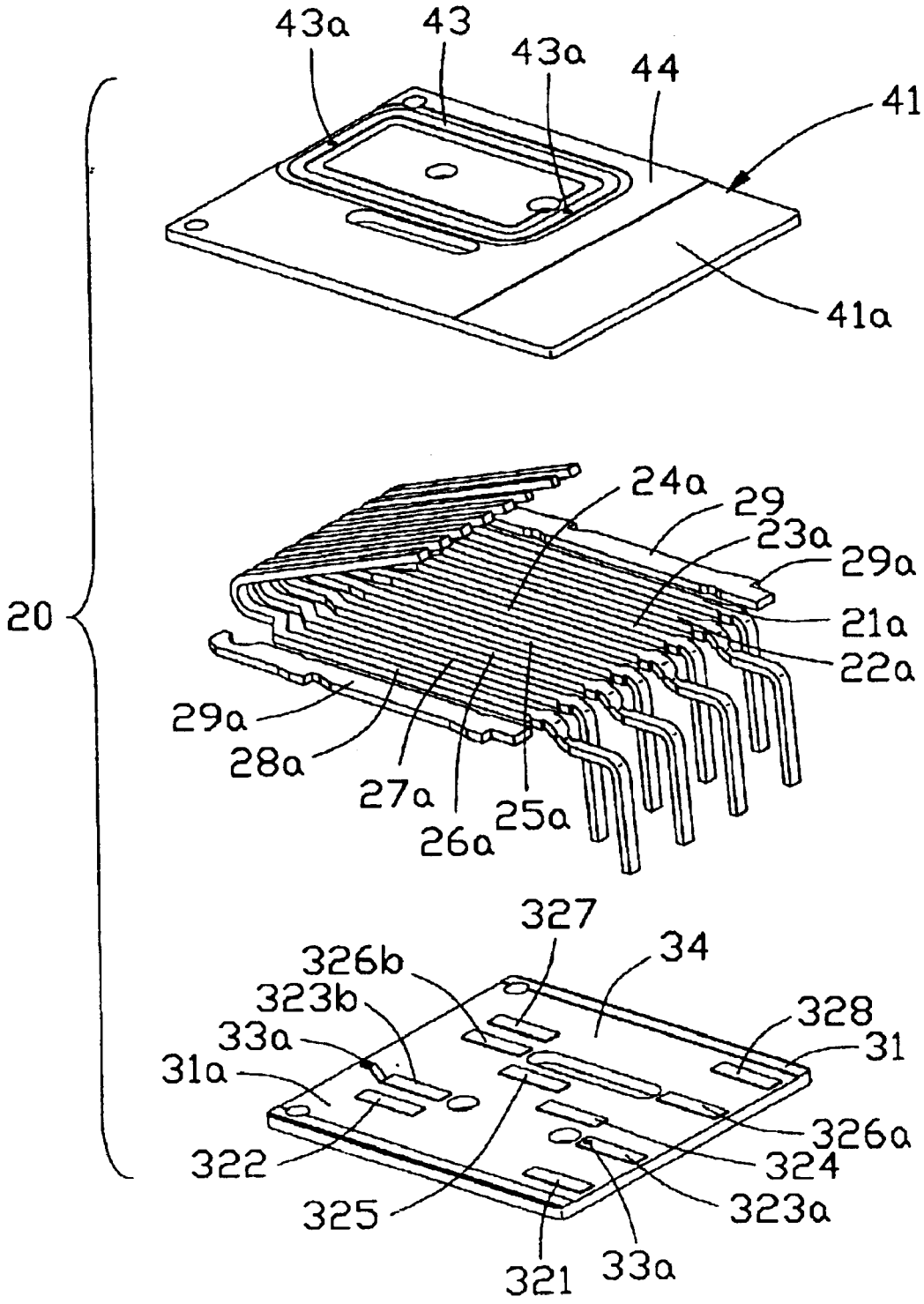
FIG. 3A is an exploded view of a terminal insert in accordance with the present invention.
Figure 3B:
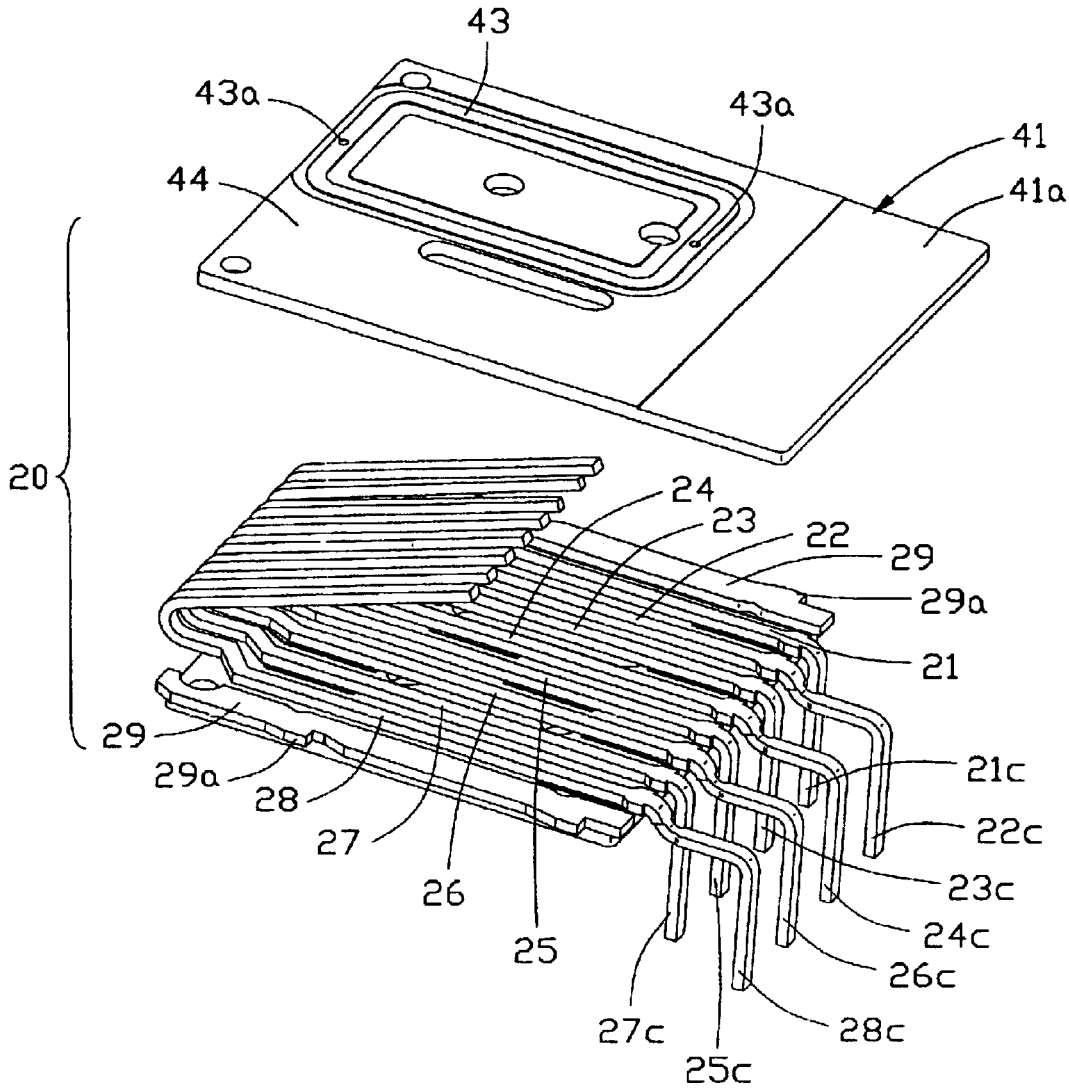
FIG. 3B is similar to FIG. 3A with terminals attached to the lower substrate.
Figure 3C:
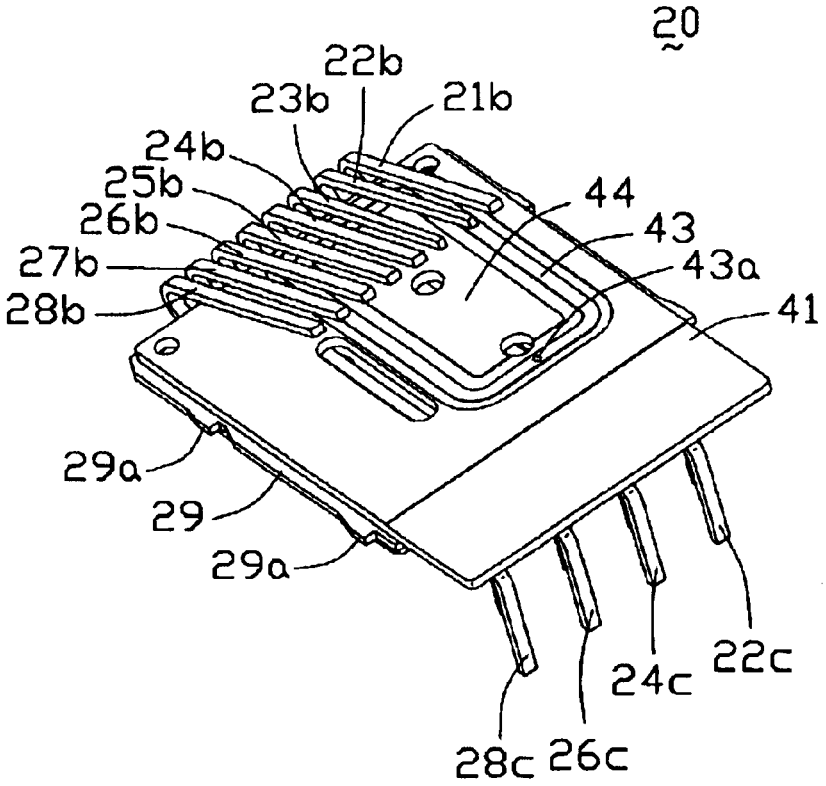
FIG. 3C is an assembled view.
Figure 3D:
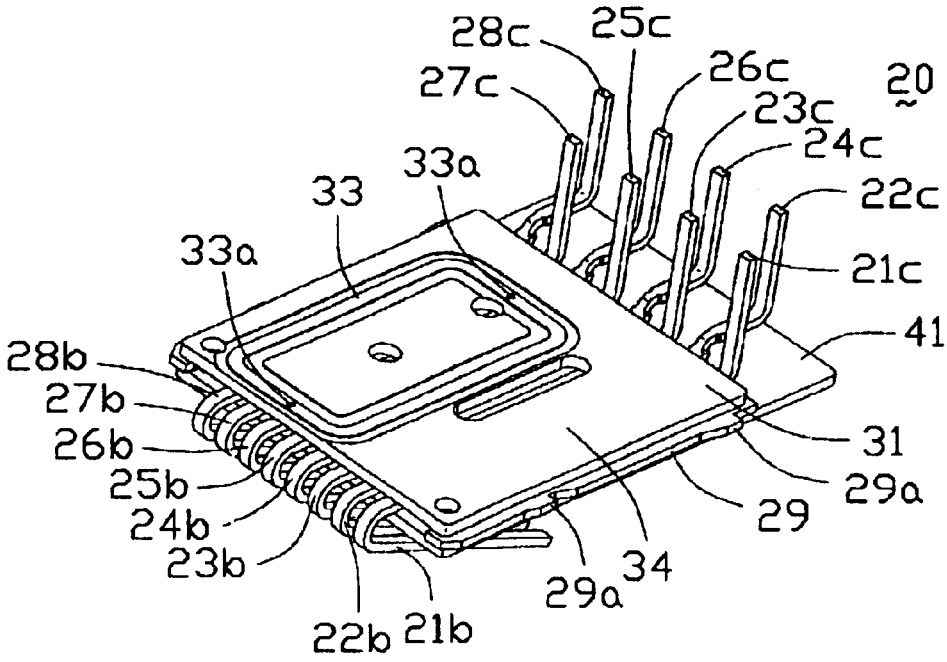
FIG. 3D is an assembled view taken from reverse direction of FIG. 3B.
Figure 3E:
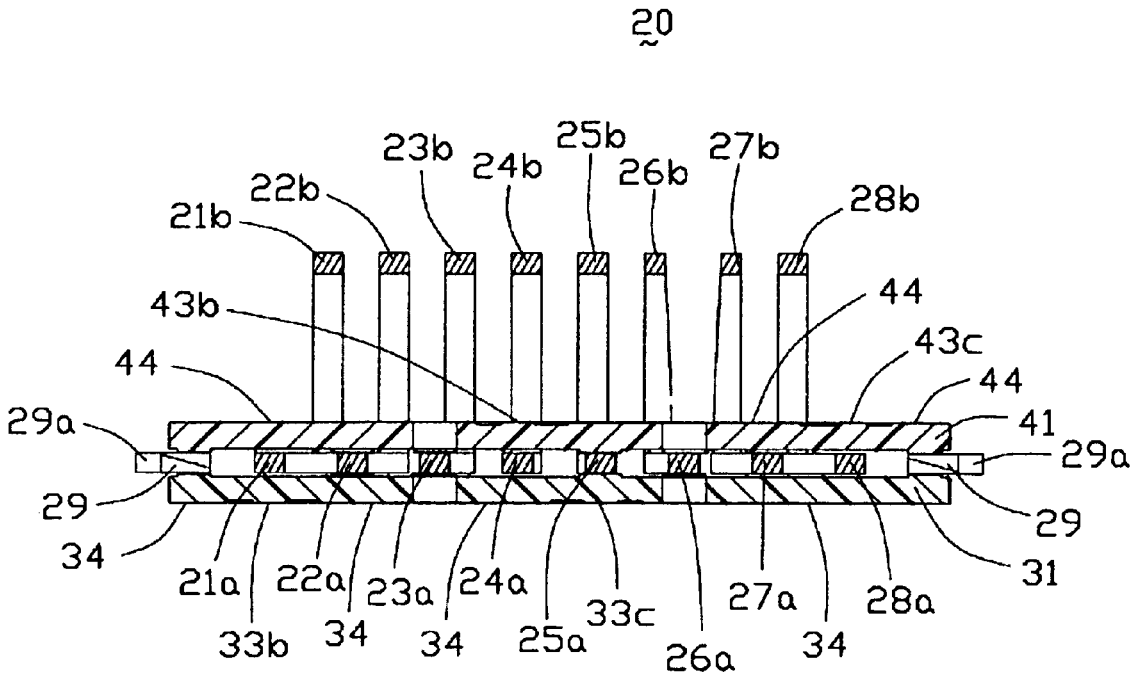
FIG. 3E is a cross sectional view taken from line 3—3 of FIG. 3B.

As clearly shown in FIGS. 2B 2D and 3E, the conductive trace 33 formed on the bottom (second) face of the first substrate 31 includes first and second portions 33*b*, 33*c* which are aligned with terminals 21 and 25, while the conductive trace 43 formed on upper (first) face of the substrate 41 includes first and second portions 43*b*, 43*c* which are aligned with terminals 24 and 28. Accordingly, electrical couplings will be generated between the first portion 33*b* and the terminal 21, and the second portion 33*c* and the terminal 25. By the same reason, electrical couplings will be generated between the first portion 43*b* and the terminal 24, and the second portion 43*c* and the terminal 28.

As it can be readily appreciated, the electrical coupling between the third terminal 23 and the first terminal 21 by means of the conductive trace 33 (via first portion 33*b*) will properly help to balance the electrical coupling between the third terminal 23 and the second terminal 22. While, the electrical coupling between the sixth terminal 26 and the eighth terminal 28 by means of the conductive trace 43 (via second portion 43*c*) will also properly help to balance the electrical coupling between the sixth terminal 26 and the seventh terminal 27. As a result, the energy coupled into terminals 23, 26 from terminals 22, 27 can be more properly balanced by the introduction of the electrical couplings between the terminals 23, 26 with respect to the terminals 21 and 28, respectively. As a result, the signal transmitted through the differential pair terminals 23, 26 benefits from balanced coupling from its adjacent terminals, such as terminals 22 and 27.

Figure 3F:
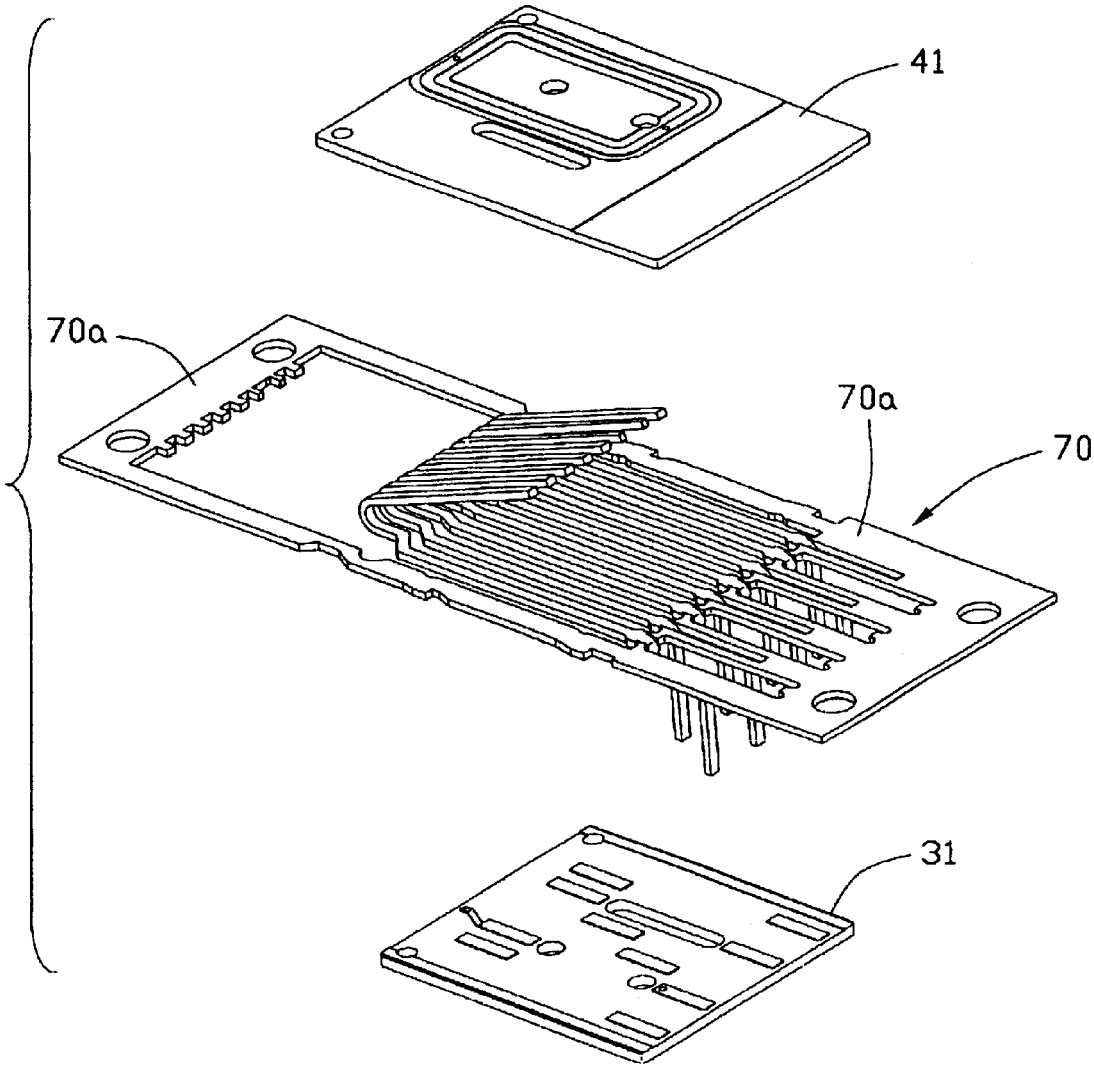
FIG. 3F is an exploded view of the terminal insert with carrier attached thereto.

As it can be readily seen from FIG. 3F, the manufacturing of the terminal insert 20 is comparatively simple as compared to the prior art in which the terminals 21 to 28 are integrally molded or assembled together. In the present invention, the terminals 21 to 28 can be simply stamped from a sheet metal 70. Then the terminals 21 to 28 can be easily sandwiched by the first and second substrate 31, 41. The carrier 70*a* can be simply trimmed off after the terminals 21 to 28 are securely attached and sandwiched between the first and second substrates 31 and 41.

In addition, it can be readily appreciated that during the stamping of the terminals 21 to 28, retaining beam 29 having barbs 29*a* can be also formed on the sheet metal 70 and which are also attached and sandwiched between the first and second substrates 31 and 41 by solder. Accordingly, the terminal insert 20 resulted therefrom can be easily inserted into the terminal insert receiving space 11 and securely attached therein by the barbs 29*a*.

Figure 4:
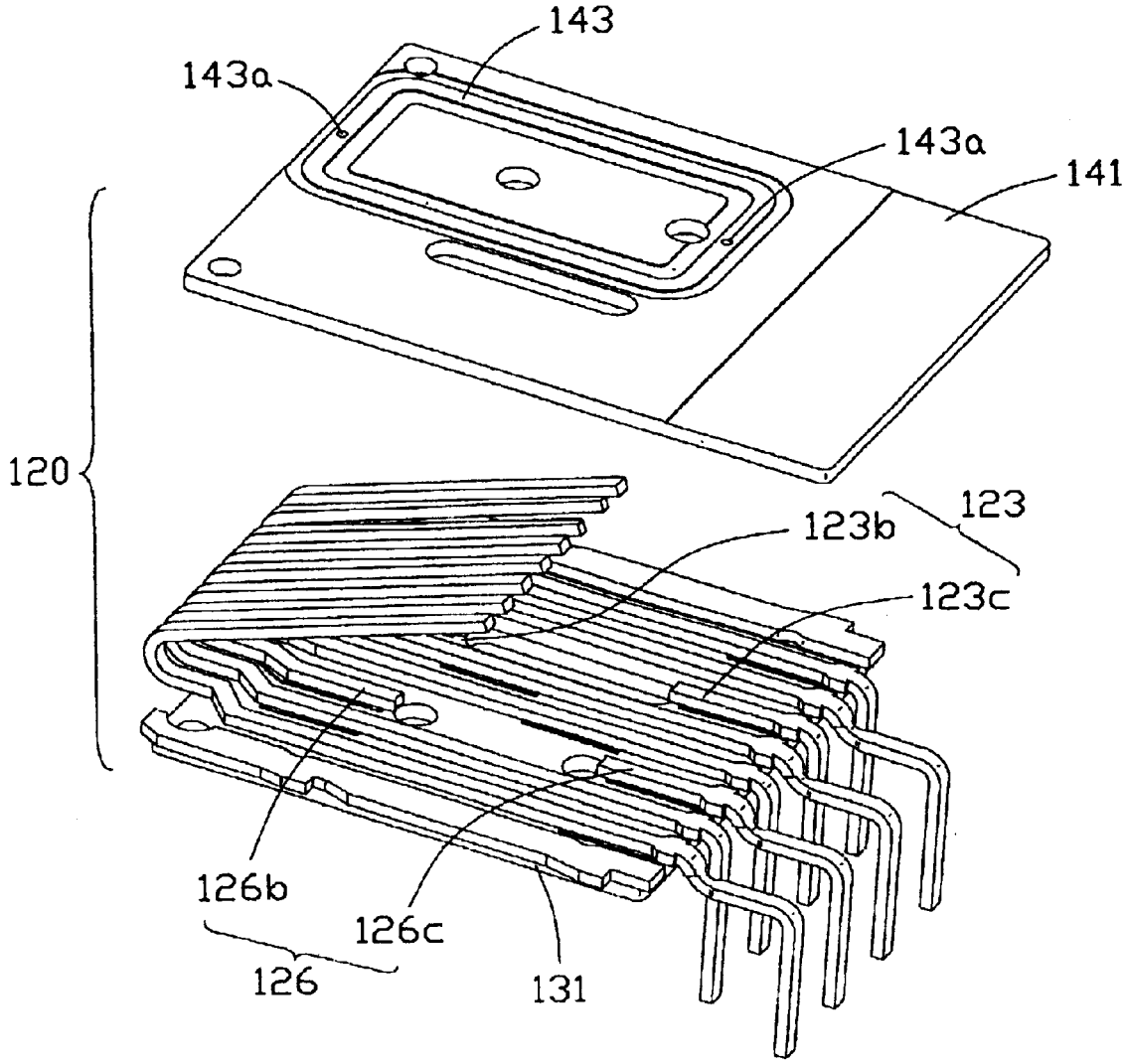
FIG. 4 is a second embodiment of a terminal insert in accordance with the present invention.

Referring to FIG. 4, a second embodiment of a terminal insert 120 in accordance with the present invention is disclosed. In the second embodiment, the base portion (not shown) of the $3^{rd}$ terminal 123 and the base portion (not shown) of the $6^{th}$ terminal 126 are cut-off such that the contact portion 126*b* and the leg portion 126*c* are electrically connected by the conductive loop by tunnels of a first substrate 131, while the contact portion 123*b* and the leg portion 123*c* are electrically connected by the conductive loop 143 by tunnels 143*a* of a second substrate 141.

Even the above embodiment uses patterns of T568A and T568B to illustrate the spirit of the present invention, it can be readily appreciated that coupling issues from other patterns, such as 3-Pair MMJ, USOC 4-pair, and TP-PMD (X3T9.5) and ATM can also be helped out by the teaching of the present invention without creating complex configuration of the terminals. By the teaching of the present invention, the terminals can be made as simple as existing terminals, while the coupling issue can be taken care by the printed circuit board.

Even the present invention illustrate is best mode of embodiments by establishing electrical couplings between conductive loops and corresponding terminals, it can be readily appreciated that the electrical couplings can be also created via conductive loops and conductive pads on which terminals are electrically connected thereto, i.e. terminals head and tails are connected to the conductive pads extending through a substrate, while the conductive loop and the conductive pads are arranged to create electrical coupling to balance electrical couplings among terminals.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A modular terminal insert for connection to a terminal insert receiving section of an RJ modular connector housing, said modular terminal insert comprising:

a first substrate having a conductive loop formed thereon;

a second substrate;

a plurality of terminals sandwiched between said first and second substrates to be contiguous with said first and second substrates, said conductive loop being coupled to selected terminals of said plurality of terminals to balance electrical couplings among said plurality of terminals.

2. The modular terminal insert of claim 1, wherein said first substrate has a first surface on which said conductive loop is formed and a second surface contiguous with said plurality of terminals.

3. The modular terminal insert of claim 2, wherein said second surface of said first substrate has a plurality of conductive pads formed thereon, said pads providing electrical connection between said conductive loop and said selected terminals.

4. The modular terminal insert of claim 3, wherein at least one of said plurality of conductive pads comprises a plurality of sections, said sections being electrically connected by said conductive loop to provide an electrical coupling among said selected terminals.

5. The modular terminal insert of claim 2, wherein said first surface of said first substrate further comprises a grounding plane.

6. The modular terminal insert of claim 1, wherein said conductive loop comprises a trace of conductive material.

7. The modular terminal insert of claim 1, wherein said second substrate has a first surface contiguous with said plurality of terminals and a second surface having a conductive loop formed thereon, said conductive loop being coupled to selected terminals of said plurality of terminals to balance electrical couplings among said plurality of terminals.

8. The modular terminal insert of claim 7, wherein said second surface of said second substrate has a plurality of conductive pads formed thereon, said pads providing electrical connection between said conductive loop on said second substrate and said selected terminals.

9. The modular terminal insert of claim 7, wherein said first surface of said second substrate further comprises a grounding plane.

10. A method for making a modular terminal insert comprising:

providing a first substrate having a conductive loop;

providing a second substrate;

sandwiching a plurality of terminals between said first and second substrates to be contiguous with said first and second substrates; and, electrically connecting selected terminals of said plurality of terminals to said conductive loop to balance electrical couplings among said plurality of terminals.

11. The method for making a modular terminal insert of claim 10, further comprising:

providing said conductive loop on a first surface of said first substrate, and rendering a second surface of said first substrate contiguous with said plurality of terminals.

12. The method for making a modular terminal insert of claim 10, further comprising:

providing a plurality of conductive pads formed on a second surface of said first substrate, said pads electrically connecting said conductive loop and said selected terminals of said plurality of terminals.

13. The method for making a modular terminal insert of claim 12, further comprising:

providing at least one of said plurality of conductive pads with a plurality of sections, said sections electrically connected by said conductive loop to provide an electrical coupling among said selected terminals.

14. The method for making a modular terminal insert of claim 11, further comprising:

providing a grounding plane on said first surface of said first substrate.

15. The method for making a modular terminal insert of claim 10, further comprising:

providing a conductive loop on a first surface of said second substrate, said loop coupling selected terminals of said plurality of terminals to balance electrical couplings among said plurality of terminals, and rendering a second surface of said second substrate contiguous with said plurality of terminals.

16. The method for making a modular terminal insert of claim 15, further comprising providing a plurality of conductive pads formed on a second surface of said second substrate, said pads electrically connecting said conductive loop on said first surface of said second substrate and said selected terminals of said plurality of terminals.

17. The method for making a modular terminal insert of claim 16, further comprising:

providing at least one of said plurality of conductive pads on said second surface of said second substrate with a plurality of sections, said sections electrically connected by said conductive loop on said second substrate to provide an electrical coupling among said selected terminals.

18. The method for making a modular terminal insert of claim 15, further comprising:

providing a grounding plane on said first surface of said second substrate.

* * * * *